US007188814B2

(12) United States Patent
Davis

(10) Patent No.: US 7,188,814 B2
(45) Date of Patent: Mar. 13, 2007

(54) CORD HOLDER WITH INTEGRAL LOCKING MECHANISM

(76) Inventor: Jerry A. Davis, 3120 Osprey Rd., Eagle, ID (US) 83616

( * ) Notice: Subject to any disclaimer, the term of this patent is extended or adjusted under 35 U.S.C. 154(b) by 271 days.

(21) Appl. No.: 10/870,760

(22) Filed: Jun. 15, 2004

(65) Prior Publication Data

US 2005/0274840 A1 Dec. 15, 2005

(51) Int. Cl.
*A47F 5/00* (2006.01)

(52) U.S. Cl. ..... 248/315; 248/51; 248/302

(58) Field of Classification Search ..... 242/129; 206/702; 248/315, 300, 302, 51
See application file for complete search history.

(56) References Cited

U.S. PATENT DOCUMENTS 3,021,010 A * 2/1962 McMasters ..... 211/49.1
3,292,877 A * 12/1966 McMasters ..... 242/129
3,796,304 A 3/1974 Blais
4,277,035 A * 7/1981 Gaski ..... 242/404.3
4,646,987 A 3/1987 Peterson
4,934,646 A * 6/1990 Doyle ..... 248/309.1
5,577,932 A 11/1996 Palmer

* cited by examiner

*Primary Examiner*—Emmanuel Marcelo
*Assistant Examiner*—Sang Kim
(74) *Attorney, Agent, or Firm*—Your Intellectual Property Matters, LLP; Robert A. Frohwerk

(57) ABSTRACT

This cord holder may be used for storage or transport of any coiled elongate article, such as a rope or electrical cord. It comprises a collar that surrounds and contains the coil, and a shank that extends away from the collar and forms a shoulder across the collar. The shank supports the coil to keep it from falling through the collar or otherwise becoming tangled or uncoiled. The collar may be open or closed, and the shank may take on various angles and shapes to accommodate a variety of coiled elongate articles. This cord holder may be made from a variety of materials and is scalable in size to accommodate varying loads. Methods of use are shown that include mounting brackets and transport features.

19 Claims, 10 Drawing Sheets

CORD HOLDER WITH INTEGRAL LOCKING MECHANISM

CROSS-REFERENCES TO RELATED APPLICATIONS

Not Applicable

Statement Regarding Federally Sponsored Research or Development

Not Applicable

Sequence Listing or Program

Not Applicable

DESCRIPTION

Field of the Invention

The present invention relates to an apparatus for holding an elongate article for display, or for packaging, or for arranging such an article in an organized manner to facilitate sale, transport, or storage. Although the held article often will be removed from the apparatus when the article is in use, there are many applications wherein the apparatus will be used as a retainer to organize the extra unused length of held articles. The described apparatus may be used with cord-like articles in the broadest sense, including electrical cords and wire, ropes, cables, hoses, tubing, straps, and the like.

BACKGROUND

In the class of elongate objects, rope is probably the oldest. Though the beginning of rope making has been lost in prehistory, there is evidence that rope was being made as far back as 17,000 BC. From early Egyptian history, we have been able to learn about how the earliest rope was made. We can surmise that because the process of rope making was quite tedious, once it had been made, the rope would have been stored for reuse. We can only assume, however, that any means of storage was very simple. It is likely that the first form of storing a rope in a more or less organized manner was to simply coil it into a series of loops and then to hang the coil on a suitable object, such as a tree branch. By the time mankind had moved into permanent abodes, he would have taken his ropes indoors with him and hung the coils on pegs attached to a wall.

In relatively more recent times with the advent of electrical cords, storage has become a more serious consideration, but most electrical cords are still stored by coiling them and hanging them on pegs, if not simply throwing them into a box or a pile on a floor. Whether rope or electrical cords, not much has changed in the manner of storage, regardless of the value or sophistication of the object being stored. The situation remains that coiled objects are generally free to uncoil and become tangled during transport or storage.

Elongate objects such as ropes and electrical cords are still most commonly coiled by hand and stored loosely or hung over a peg. Sometimes a strap or tie is wrapped around the coiled object to keep it from uncoiling or otherwise coming loose. In his 1974 U.S. Pat. No. 3,796,304, Blais described one of many types of collars or sleeves that have been devised to hold coiled objects. U.S. Pat. No. 5,577,932 issued to Palmer in 1996 was for a variety of helical spring segments, which could be wrapped around coiled electrical cords in various manners to prevent them from becoming uncoiled whether in storage or in use.

Manufacturers of cords for telephones and small appliances often attempt to reduce the storage problem by shortening the cord when it is not in use. Such cords may be preformed into tight spring-like coils along their length or may use a retracting spring inside the cord to shorten it when not in use. Peterson's 1987 U.S. Pat. No. 4,646,987 shows a spring operated take-up reel that is connected at mid-length of a flat telephone cord so that the reel winds the opposite end portions of the cord into a single spool. This method works well for thin flat cords or tapes, but becomes problematic for heavier items. Larger, bulkier items may be stored by rolling them onto a spool for retention. Cable reels with collector rings and retracting springs designed for storage of cables and cords have also been used for tubing and hoses. As Palmer ('932) said in 1996, it is apparent "that no effort has been placed on retaining of electrical cord or cable after it has been wound into a coil."

Another common form of storage has been to wind the elongate object into a hank. One method that prevents unwinding is what is known as the "clothesline hank" in which one end of the elongate object is wound about the midportion of the hank in a spiral fashion and then that end is tucked through the loops at one end of the hank to secure them from unraveling.

In the prior art we find devices ranging from simple cardboard sleeves used for shipping, and pegs used for hanging during storage, to some of the more elaborate devices mentioned above. Though a simple peg works well for storage on a wall, it does nothing to avoid tangles when the coil is removed from the peg. The present invention solves both problems since the described holder may be removed from its storage location to be used as a carrier for transport of the coiled object. The described cord holder locks the cord tighter into a smaller coil and is more durable than many items in the prior art. Several embodiments of the present invention achieve simplicity of design with the ability to inexpensively manufacture them as single piece items.

BRIEF SUMMARY OF THE INVENTION

It is the primary objective of the present invention to provide an apparatus that can be easily loaded with a coiled elongate object to manage the compact shape of the coil during both storage and transport. For ease of reference, the term "cord" will be used here to describe any elongate object, such as ropes and strings, electrical cords, wires and cables, hoses and tubing, straps and many other similar objects. Hence, the present invention is primarily a cord holder, although the functionality of a hanger is also incorporated into the design. In its simplest form the described cord holder is based upon a concept derived from the clothesline hank. Also, although the cord that is to be held will generally be referred to as being in the form of a coil, this is not to overlook the minimal case where a relatively short cordlike object is suspended from near its midpoint in an inverted "U."

In its most basic form the described cord holder is a simple, rigid harness that is easily inserted into any coiled cord so that the cord can be suspended for storage, or supported for transport, or otherwise managed to maintain its compact shape. The cord holder may be formed from a single piece of rigid material, solid or tubular, beginning in the shape of an inverted tee. For descriptive purposes consider that the arms of the tee lie in a horizontal plane at the base, and what would normally be considered the leg of the tee becomes more generally a shank rising vertically above its intersection with the arms. The distal ends of the arms of the tee are drawn toward one another to form an oblong loop, or collar, in the same horizontal plane as the base of the tee. The collar may be closed but need not be, however, in an open collar configuration the arms must extend far enough to form hooks near their distal ends. The shank is bent at an angle across the collar, toward the distal ends of the arms. The midsection of the shank above the intersection with the arms has a shoulder that is more or less pronounced. The distal end of the shank above the shoulder may terminate in a variety of end treatments to accommodate different mounting mechanisms and modes of transport, including mounts for walls and under counter use, as well as belt loops, hooks or other shapes with which to suspend the coil in storage. The shank may terminate without a suspension appendage for containment of countertop appliance cords, or computer wiring behind a desk.

When in use, the collar surrounds and contains a coiled cord in order to hold the coil together. A cord holder made with a closed collar may be slipped down over the coil and then tilted so that the shank engages the upper portion of the coil. The coil will then be locked into place by pulling it down firmly against the backside of the shoulder of the shank. When using an open collar device, the coil may be draped over the back of the shank and then tucked between the open ends of the arms of the collar and pulled snug. Each of these and other related methods effectively locks the coil from unraveling; the shank providing support while also locking the coil into place. Various functional shapes of the shank facilitate loading and unloading of the coil within the collar and provide various means of suspension. The design of the cord holder is such that it allows any length of cord to be in use with the remaining coils held tightly in place.

The basic device may be manufactured from many materials, and in many different sizes, to adapt to many types of coiled objects. It may be molded or formed as a single piece, or assembled from separate collar and shank components that may be attached to one another by any secure means of attachment. The cord holder may be sold as an add-on with elongate objects, such as appliance or extension cords, where it may enhance sales in some retail markets. A variety of accessories are possible for special environments and applications.

BRIEF DESCRIPTION OF THE DRAWINGS

FIG. 8 illustrates alternate embodiments of the present invention wherein the collar is hinged to allow the ease-of-use of an open collar configuration while providing the security of a closed collar. A ball and eye clasp is shown as an example of a latching mechanism.

FIG. 8B—a doubly hinged collar

FIG. 10 shows a variety of treatments for the distal end of the shank that are useful in different applications of the present invention.

FIG. 10B—a wireframe embodiment having a hooked end for suspension

FIG. 10C—a wireframe embodiment made from a single wire loop having a hooked end for suspension FIG. 10D—an elevation depicting the overhang of the distal end of the shank required of embodiments similar to those shown in FIGS. 10A, 10B and 10C FIG. 10E—a T-handle FIG. 10F—a loop handle for carrying or hanging FIG. 10G—an elevation indicative of the overhang of the distal end of the shank to provide proper balance for embodiments similar to those shown in FIGS. 10E and 10F

DETAILED DESCRIPTION

Figure 1:
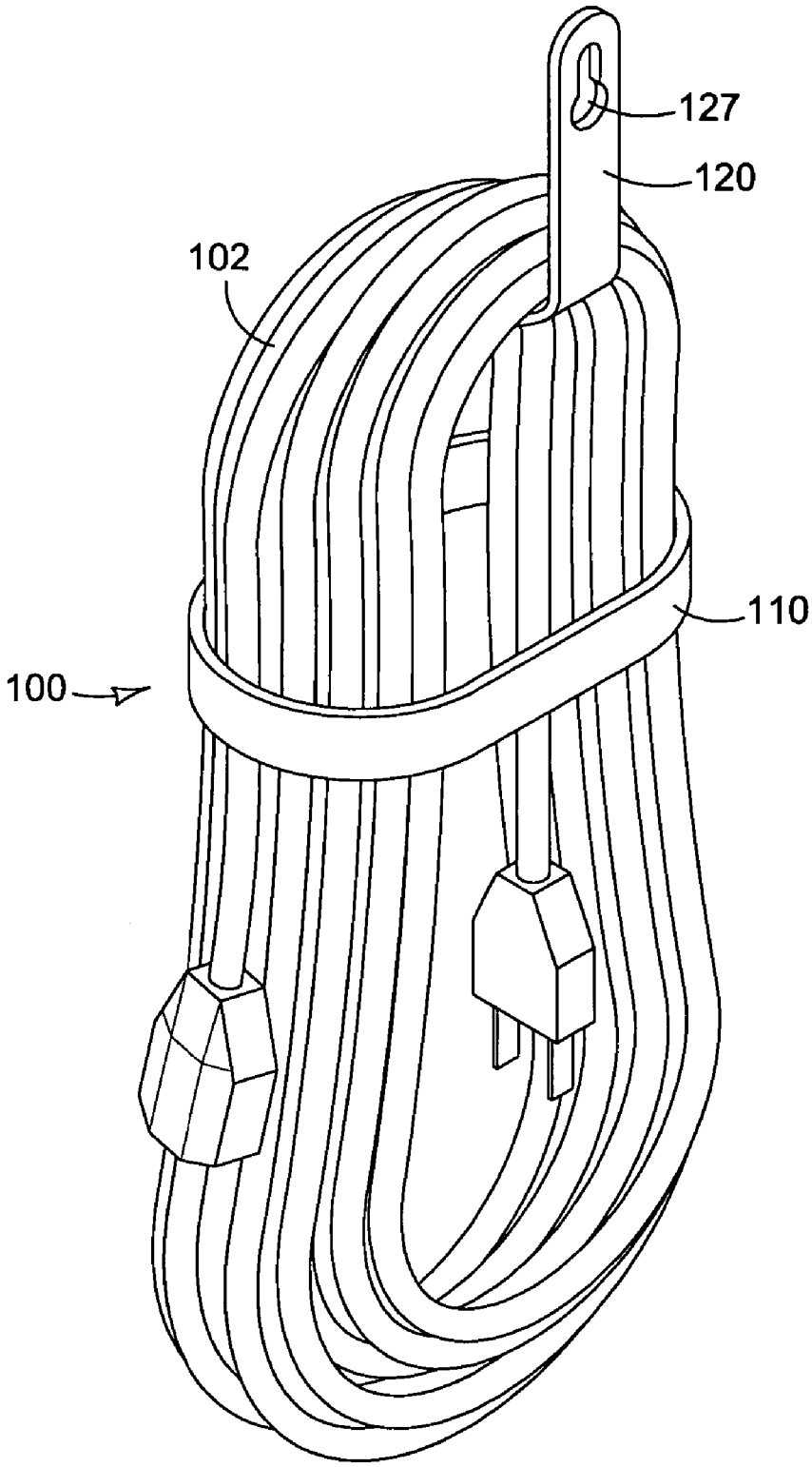
FIG. 1 is a depiction of a cord holder of the present invention holding an electrical extension cord.
Figure 2:
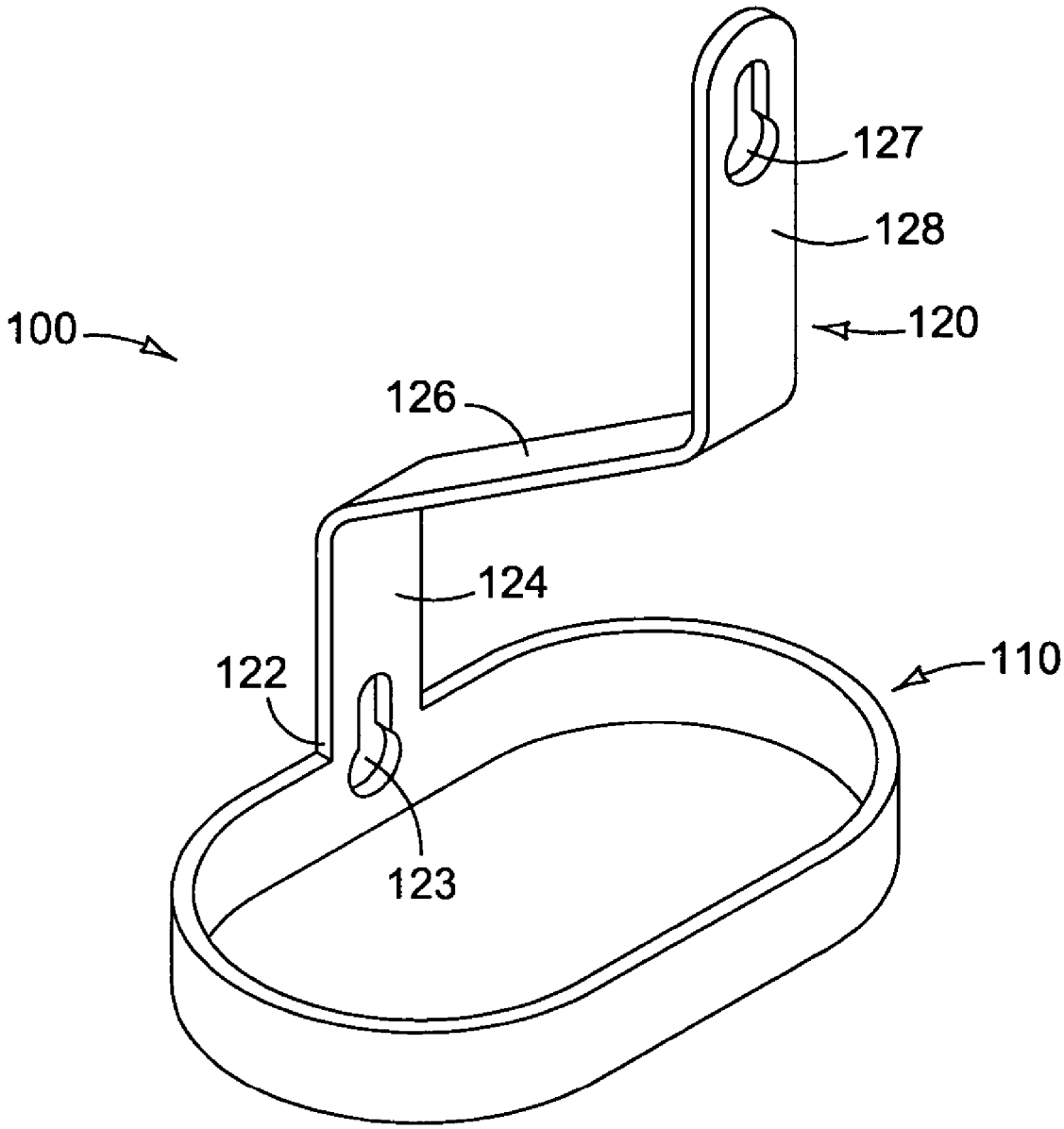
FIG. 2 shows in perspective a one-piece form of a basic closed collar model of the preferred embodiment of the present invention with mounting holes.

The preferred embodiment of a cord holder 100 in the present invention is shown in use in FIG. 1, where it supports and contains a coil 102 of electrical extension cord for storage. As depicted in FIG. 2, an empty cord holder 100 exhibits the basic theme, being shown in the same orientation in which it will normally be used. It comprises two basic portions, namely, a collar 110 with an integral shank 120 rising orthogonally from the collar 110. The proximal end of the shank 120 emerges from the collar 110 into the base 122 of the neck 124. The neck 124 rises into a shoulder 126, which extends to the upper shank 128 at the distal end of the shank 120. The angle between the collar 110 and the shoulder 126, after discounting the offset due to the length of the neck 124, will generally be about 45°, and seldom greater than 60°, depending upon the size, weight and flexibility of the coil 102 to be supported by the cord holder 100. The collar 110 may be closed as in FIG. 2, or open, as will be seen in FIG. 7. In the alternate open collar embodiment, the opening will be defined by the distal ends of the collar 112 and will be opposite where the shank 120 meets the collar 110 at the base 122 of the neck 124.

Most alternate embodiments will follow the preferred embodiment with regard to the fact that the collar 110 and the shank 120 will be formed from a single continuous piece of rigid material. However, this is not necessary to the intent of the present invention. If the collar 110 and the shank 120 are formed from separate components rather than from a single continuous piece of rigid material, they may be attached to one another by welding or bonding, bolting or screwing, riveting, or stitching or lacing, or other means of secure attachment appropriate to the material from which they are formed. The critical elements of the described invention are the presence of the collar 110, whether open or closed, and the shank 120 with its shoulder 126. Lacking any of these elements, the described invention would not function in accordance with the purpose of its design.

When the cord holder 100 is being used to hold a coil 102, as seen in FIG. 1, the weight of the coil 102 is to be borne on the shoulder 126 (FIG. 2) of the shank 120. For this reason, the shoulder 126 and any intervening portion of the cord holder 100 between the shoulder 126 and the point at which the cord holder 100 is mounted or suspended must be of sufficient rigidity and strength to support the load imposed by the coil 102 in that particular application. It is important that the cord holder 100 is sufficiently rigid to maintain its general shape under the weight of the coiled object 102; that is, the cord holder 100 should not deform under its load. If the coiled object is a telephone cord, then stiff leather or possibly even fabric might suffice for a closed collar embodiment. However, a long rope or heavy extension cord may require metal bars or at least heavy wire to avoid deformation. The shank 120 must be sturdy enough to support the weight of the coil 102 and appropriately broad so as to distribute the load and avoid leaving a detrimental indentation. The rigidity and strength of the collar 110 are less critical since it should bear little if any weight, though it must be capable of holding the coil 102 snugly, keeping it compact so as not to become dislodged.

Figures 3, 4, 5, 6:
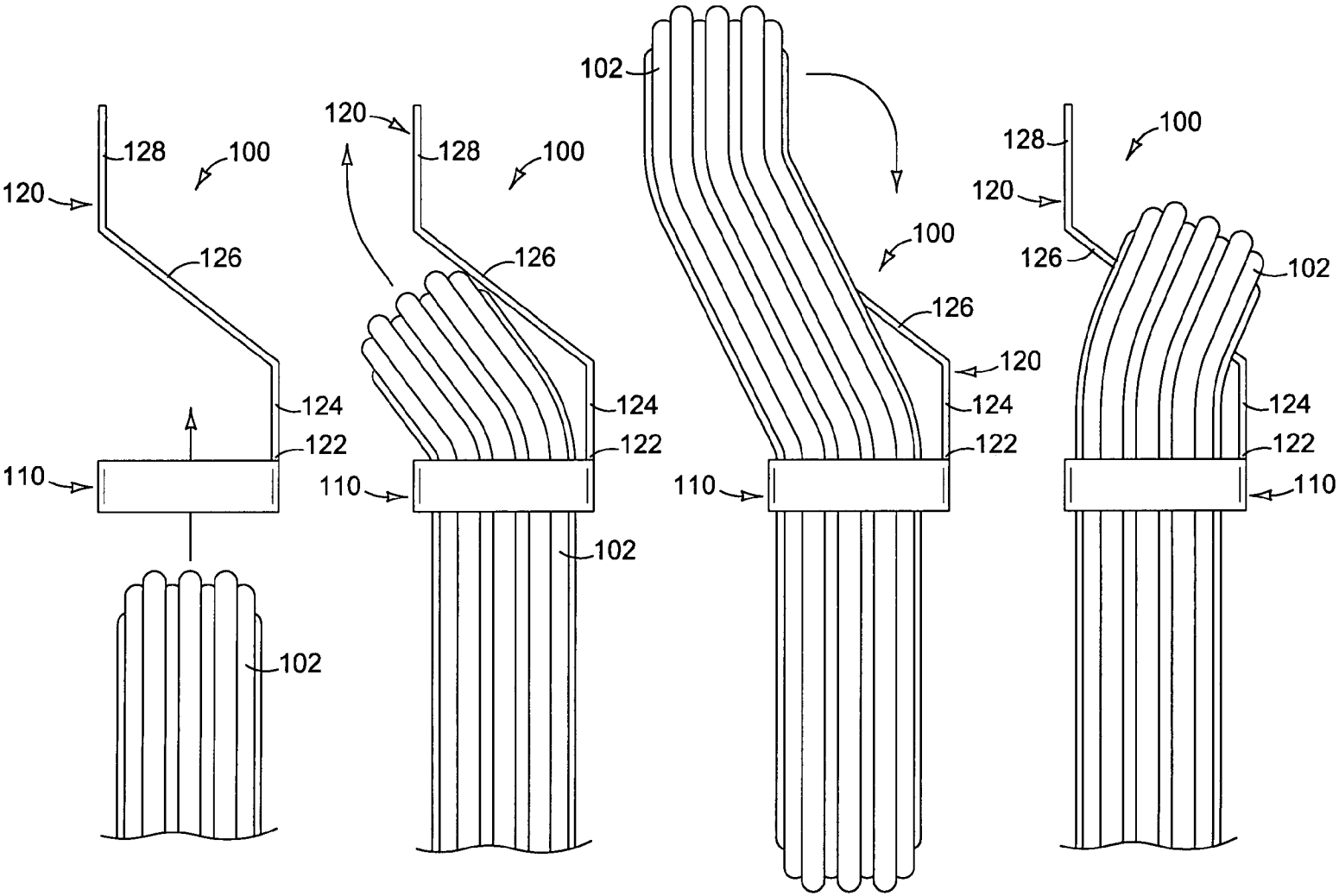
FIGS. 3–6 illustrate in sequence the loading of a coiled cord into a cord holder in keeping with the present invention.

The desirability of alternate embodiments will become apparent when considering the many ways in which the cord holder 100 may be used. Consider first the use of the preferred embodiment with a closed collar, as shown in FIG. 2. Use of an optional mounting hole 123 in the neck at the base of the shank 124 allows this cord holder 100 to be hung on a wall with its shank 120 extending outward. To load such a cord holder 100, the coil 102 would be slipped up into the collar 110 from below (see FIG. 3 and FIG. 4) until the upper portion of the coil 102 extended far enough to clear the distal end 128 of the shank 120 as shown in FIG. 5, at which point the upper portion of the coil 102 would be adjusted to fall over the back of the shank 120 onto its shoulder 126 as in FIG. 6. The coil 102 may be disengaged from the cord holder 100 without removing the cord holder 100 from the wall by simply sliding the coil 102 upward far enough to clear the upper end of the shank 128, then tilting the upper end of the coil 102 outward and pulling the coil 102 downward away from the end of the shank 128 to release the coil 102. Alternately, the cord holder 100 with the coil 102 intact could be dismounted from the wall and transported to a worksite where the cord holder 100 could then be separated from the coil 102 in the above-described manner without concern that the coiled object would have become tangled during transport.

A variation of the depicted process allows for loading of a freestanding cord holder 100, whether made with a closed (FIG. 2) or open (FIG. 7) collar. In either case the collar 110 of the cord holder 100 may be slipped over the upper portion of the coiled cord 102 and down far enough on the coil 102 to allow the distal end 128 of the shank 120 to be tilted so as to engage the upper portion of the coil 102. Pulling the shank 120 firmly back against the inside of the upper portion of the coil 102 locks the coil 102 on to the cord holder 100, readying it for storage or transport.

Figure 7:
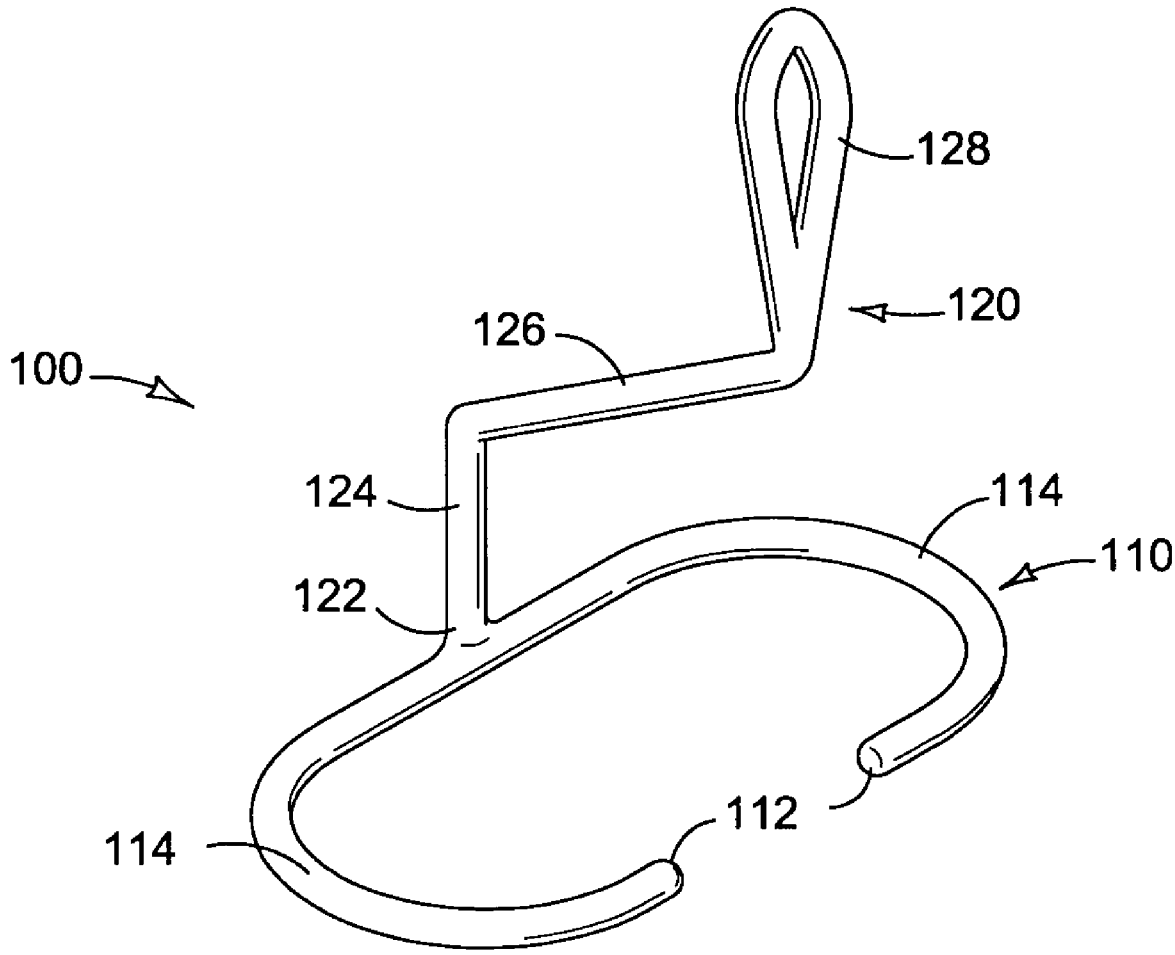
FIG. 7 is a perspective view of an open collar version of the present invention in its most basic form made from wire that may be coated.
Figure 8A:
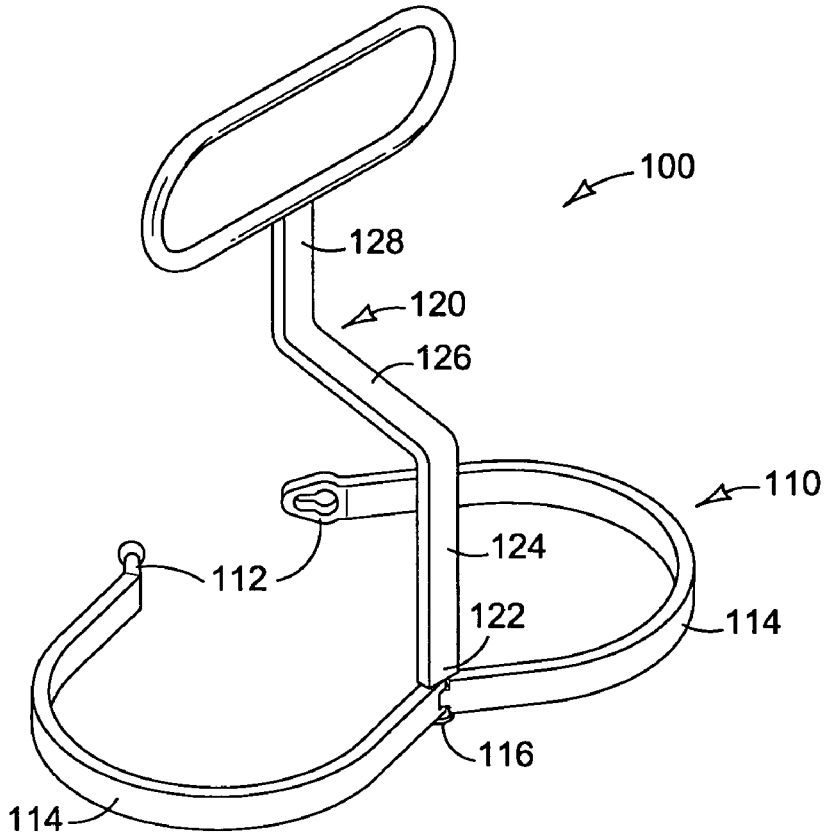
FIG. 8A—a single central hinge
Figure 8B:
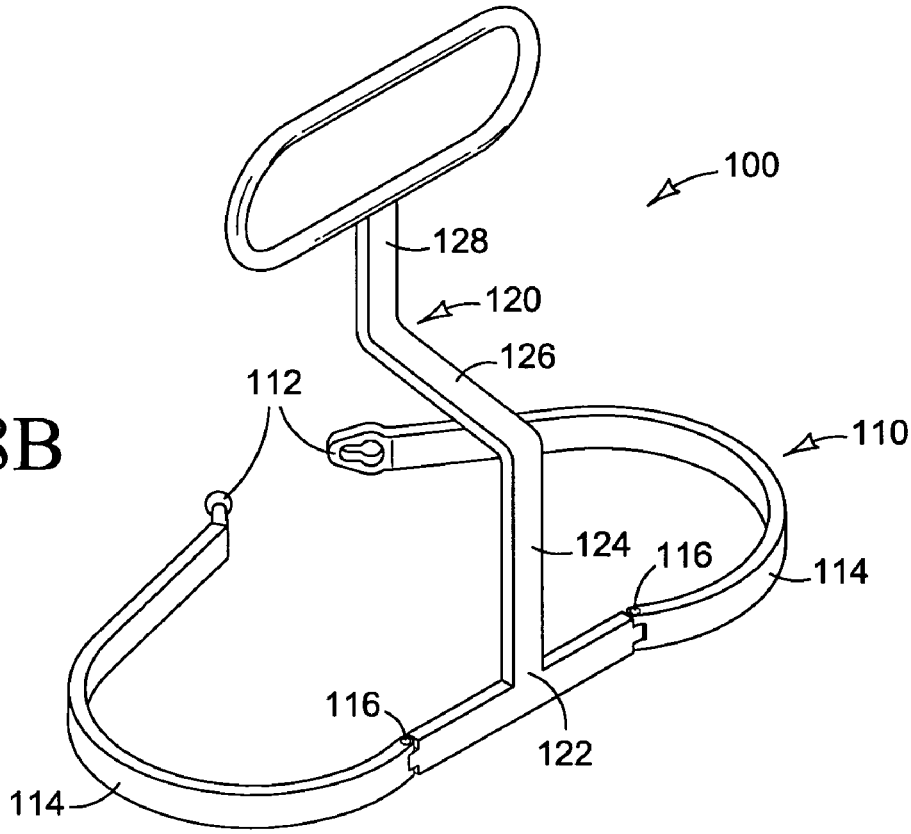

The open collar device of FIG. 7 is perhaps better suited for larger or heavier coils 102. Here, the coil 102 may be draped over the back of the shank 120, coming to rest on the shoulder 126. Then the sides of the coil will be tucked into the open collar 110 between the open ends 112 of the arms 114, one side at a time. The coil 102 will then be pulled snugly against the back of the shoulder 126 of the shank 120 to lock the coil 102 securely into place. Alternatively, for stiff or bulky objects, it may be easier to squeeze the coil near its center, where its cross-section will be smaller than at the ends of its loops, place the squeezed portion of the coil inside the open collar 110, relocate the upper loops of the coil over the back of the shank 120 and then pull the entire coil snugly into a locked position against the back of the shoulder 126. The open ends 112 of the arms 114 of the oblong collar 110 must extend far enough to provide a sufficient hook to prevent the coil 102 from becoming dislodged when in storage or gentle transport. This means that the arms must extend somewhat more than 90° around the potential circumference of the collar on each side of their junction at the base 122 of the shank 120, but generally not much more than about 150° on each side.

Where the transport is likely to be rough but it is desired to use an open collar cord holder 100 in order to facilitate loading of the coil 102, an alternate embodiment of the invention allows the open collar 110 to be closed by connecting the arms to secure the coil 102, and then releasing the connection from the arms to extract the coil 102 after transport has been completed. Examples of such embodiments are shown in FIG. 8. The arms may be hinged at one or more points appropriate to the type of coil 102 that is to be held. A variety of latching mechanisms may be used to secure the collar 110 from being opened inadvertently. Those skilled in the art of fasteners will recognize that the open collar 110 may be closed by a wide variety of hooks, hasps, buckles, latches, etc. in addition to the ball and eye clasp shown here. Since the closure for an open collar is nonstructural, a flexible material may be applied at the ends of the arms. In some embodiments the closure could be made from spring steel arms terminated in an appropriate manner of hook mechanism. Other embodiments allow for the addition of various appendages to the distal ends 112 of the arms 114 to close the collar. One such set of appendages may include a strap of a hook portion of a hook and loop fastener as an extension to the distal end 112 of one the arms 114 and the loop portion of a hook and loop fastener added to the distal end 112 of an opposing arm 114. In similar manner, various button, snap or other closures may be appended to provide closure of the collar 110.

Many other alternate embodiments allow the upper shank 128 to receive a variety of treatments for special applications. By using an optional mounting hole 127 in the upper shank 128 as was previously shown in FIG. 2, a cord holder 100 may be attached semi-permanently to a wall or other surface. This mode may be useful, for instance, with electrical cords where it is desired to shorten a cord's effective length without cutting or replacing it, or even removing it from service. One example is the storage of a power or data cable behind a computer desk or entertainment center. In such a situation, after the cord has been connected at both ends and put into service, it may be desired to gather the slack of its excess length into a coil for storage on a cord holder 100. This can easily be accomplished as described previously. To continue with this example, it may be advantageous for the optional mounting hole 127 to be formed in the shape of a keyhole slot so as to provide for slidably mounting the cord holder 100 onto the head of a screw that has been inserted into the desk or wall. Such a cord holder 100 may then later be slidably unmounted as needed.

A closely related example might use a keyhole mounting slot at the back of the collar 110 below the shoulder 126. This allows a similar semi-permanent mounting of the cord holder 100 while allowing the coil 102 to be readily removed without the necessity to unmount the cord holder 100. For large loads or to prevent the cord holder 100 from being inadvertently reoriented, more than one hole may be used, placing multiple holes either side-by-side or one above another along the base of the neck 122.

Figure 9:
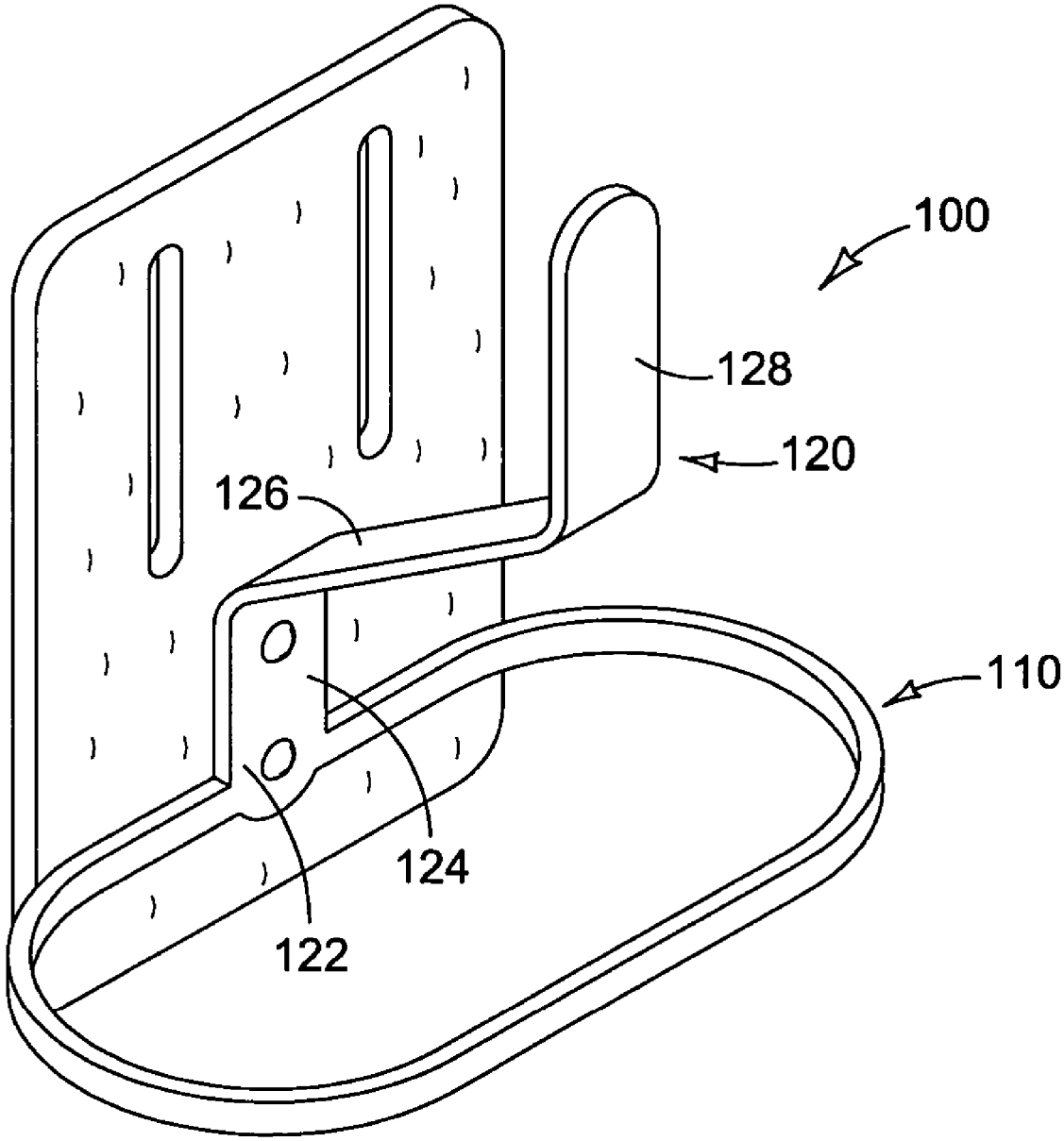
FIG. 9 illustrates a cord holder of the present invention in an embodiment that may be worn on a contractor's belt to carry an electrical or other cord.

In yet another embodiment the cord holder 100 may be attached, for instance, to a heavy leather tab as shown in FIG. 9. Slots in the tab would allow a worker to carry the cord holder 100 to a worksite on a belt while keeping his hands free. Although a leather tab has been described for this application, it will be recognized that many other materials may be used for mounting to a belt, some of which are sufficiently sturdy plastic, webbing, or even thin metal plates.

Figure 10A:
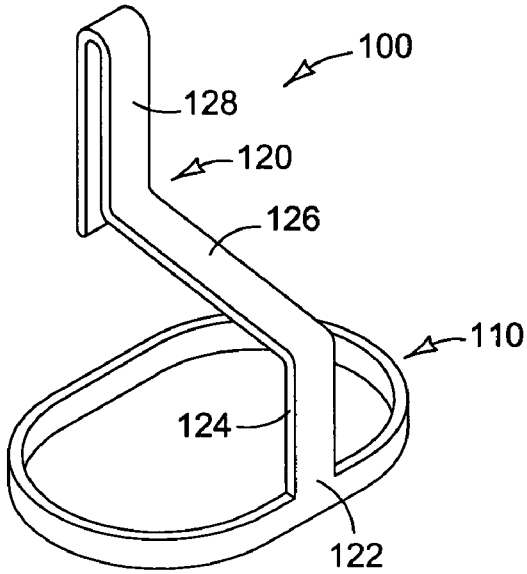
FIG. 10A—an alternate suspension that may be hooked over a tool bucket
Figure 10B:
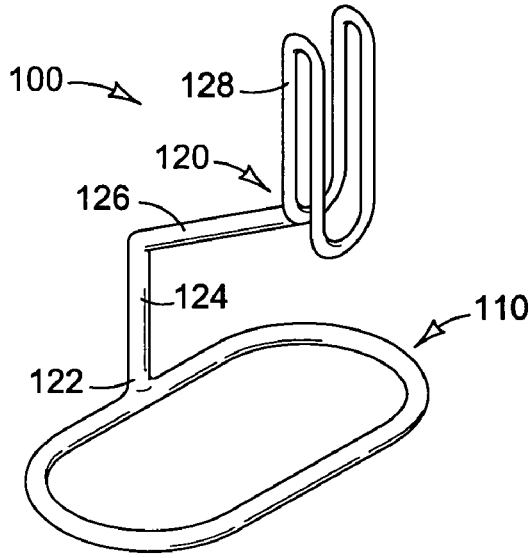
Figure 10C:
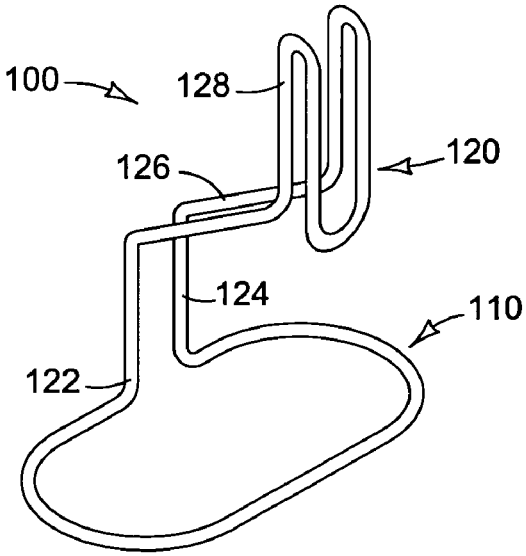
Figure 10D:
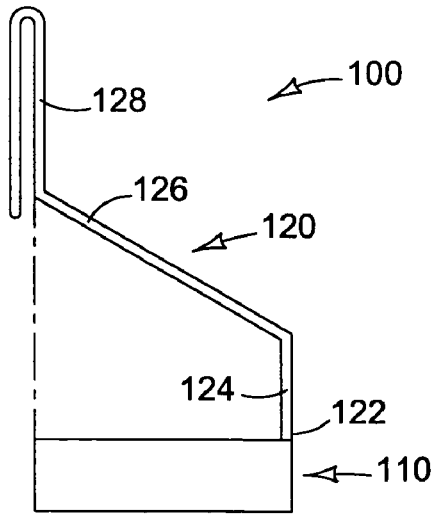

Another mounting format that provides a worker with hands-free transport of a coil 102 to a worksite is shown in FIGS. 10A through 10C. In these examples the distal end of the shank 128 is formed into a hook. The hook may be hung over a worker's belt, the lip of a tool bucket, or other equipment or machinery for transport. It will be noted that the embodiment of FIG. 10C is formed from a single loop of stiff wire, having a low cost of materials while providing stability due to the broad neck 124 and hook. FIG. 10D. is an elevation showing the requirement that the hook at the distal end 128 of the shank 120 must overhang the far side of the collar 110 to provide suitable stability to the cord holder 100 and comfort to one who might be wearing it.

Figure 10E:
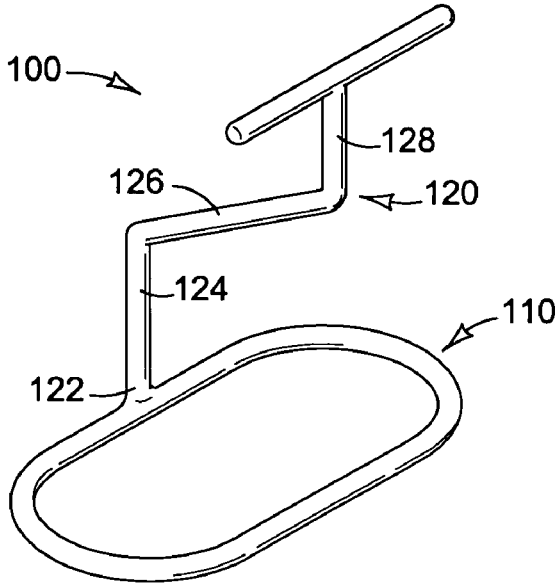
Figure 10F:
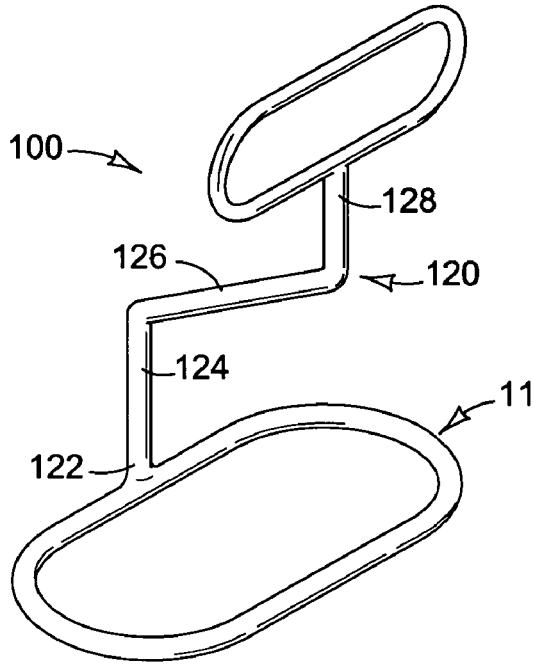
Figure 10G:
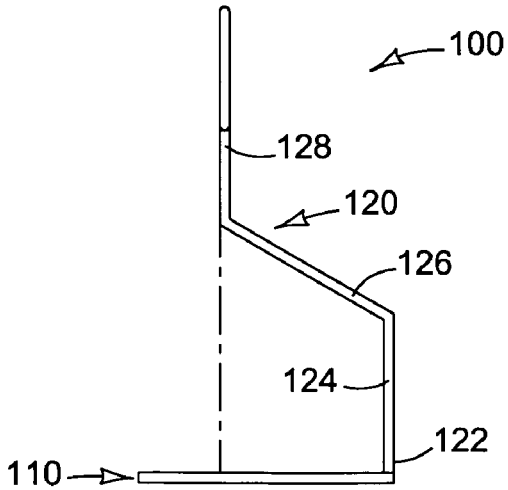

Other possible treatments for the distal end 128 of the shank 120 include a T-handle as depicted in FIG. 10E, while forming a loop at the distal end 128 of the shank 120 as shown in FIG. 10F provides still another option for carrying or suspending the cord holder 100. The elevation drawing in FIG. 10G suggests the desirable position of handles and other carrying devices. For proper balance, a handle at the distal end 128 of the shank 120 should be located over the center of the collar 110 or somewhat beyond it.

Figure 11:
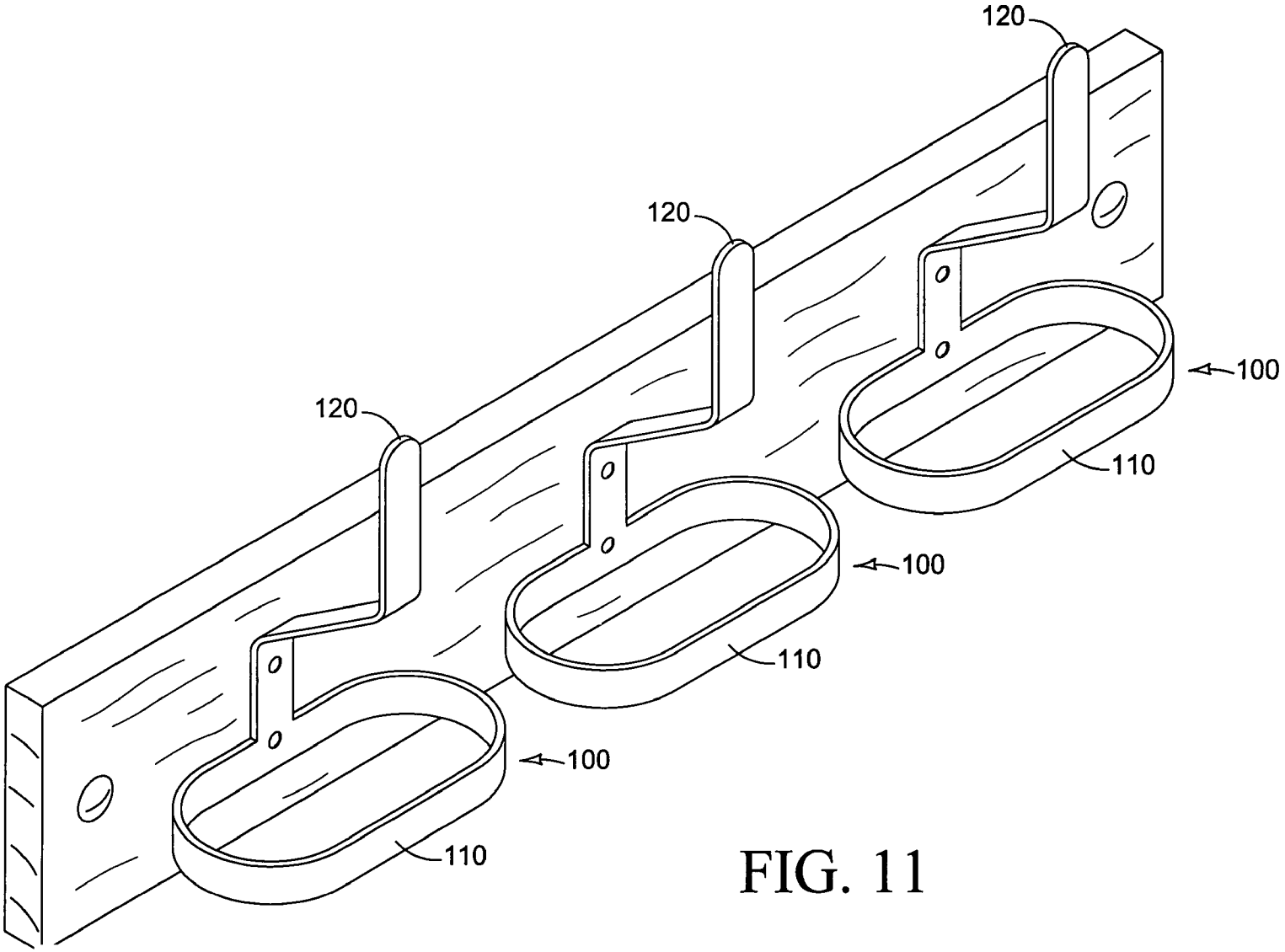
FIG. 11 depicts a multiplicity of instances of the present invention on a mounting bar as may be used on a wall, behind a desk, or under a counter.
Figure 12:
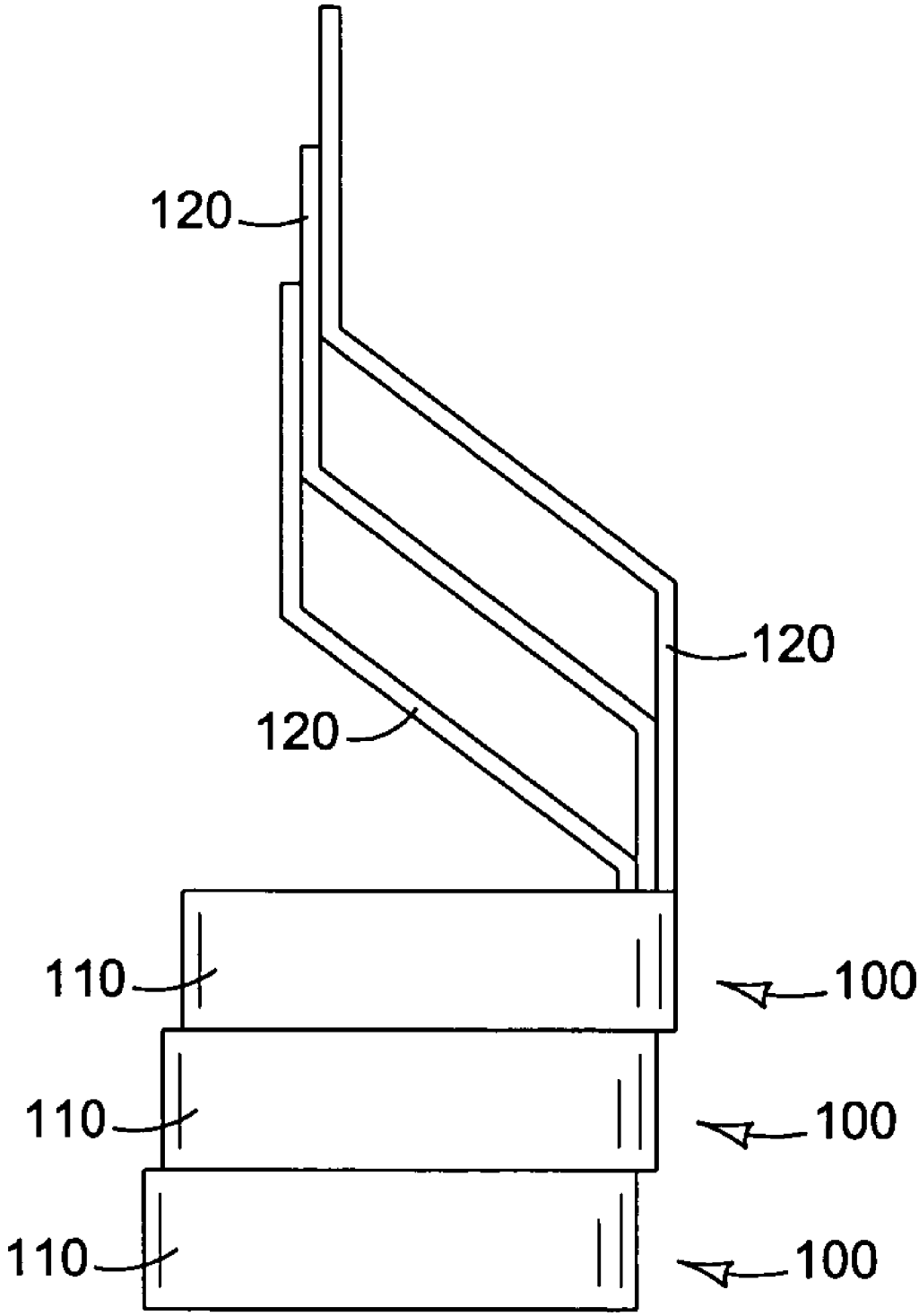
FIG. 12 shows a multiplicity of an embodiment of the present invention in a stackable form for distribution as part of a storage organization system for cords.

Since various formats and uses of the present invention have been described, it will be readily recognized that multiple instances of the basic cord holder 100 may be combined to form a storage array. An example of this is shown in FIG. 11 where multiple discrete instances of cord holders 100 are mounted on a bar that may in turn be mounted on another surface. This may be useful, for instance, for storing an array of appliance cords at a kitchen counter where embodiments of the present invention are smaller and less obtrusive than items in the prior art. Other uses of a storage array are to organize a myriad of cables behind a computer desk, or a variety of cords, ropes, or other coiled objects in a closet or on a garage wall. Furthermore, the present invention allows preassembly of multiple cord holders 100 into an array to be constructed and managed as a single product. Such preassembly may include the forming of multiple collars 110 with corresponding shanks 120 as a single unit on a common foundation. Alternately, cord holders 100 may be formed so that they are stackable, as shown in FIG. 12, allowing a multiplicity of them to be distributed in a compact package to be separated and mounted by the purchaser, either individually or as an array. A stackable embodiment of a cord holder 100 must be formed so that the shank 120 does not interfere with the next cord holder 100 in a stack. In another configuration cord holders 100 of various sizes may be nested one within another as a variety, or sampler, pack, the combination requiring no more warehouse or retail shelf space than the largest cord holder 100 in the pack.

Manufacturers who ship their products in the form of a coil may find an embodiment of the present invention to be useful as a means of containment during shipment. A common example is the distribution for sale of electrical extension cords. Such items are often merely coiled and slipped into a cardboard sleeve. If the sleeve tears or slips off of the coiled cord, the coil may become undone and the cord tangled or damaged. However, securing the coiled cord with an instance of the present invention will lock the coil into place without concern for such mishap. It is an additional advantage to the purchaser of a cord that has been shipped in this manner that the shipping container is reusable as a storage device, enhancing the perceived value of the purchased item.

While the present invention has been described with respect to a preferred embodiment, and several alternate embodiments have been shown, there is no implication to restrict the present invention to preclude other implementations. It is easily recognized that the described invention may be produced in various sizes and is scalable to accommodate a wide range of loads. It may be used with any cord-like article, including but not limited to the electrical cords, wire, cable and ropes that have been used here for illustrative purposes, and for such items as hoses, tubing and flexible pipe, belts and straps, and even the seemingly unmanageable plumber's snake. It may be constructed from a variety of materials. Though the cord holder of the present invention will most commonly be formed from rigid materials like molded plastic or metal, or from stiff wire, either coated or uncoated, lighter duty applications may use flexible materials such as leather, webbing, thinner plastic, cardboard, etc. The necessary rigidity of the cord holder is relative to the size, load, and stiffness of the coil being held.

Though the present invention has been described with reference to a preferred embodiment and multiple alternate embodiments, various further modifications will be apparent to those skilled in the related arts. Therefore, it is not intended that the invention be limited to the disclosed embodiments or the specifically described details, insofar as variations can be made within the spirit and scope of the appended claims.

I claim:

1. A cord holder for containment and support of a coiled elongate object, the coiled elongate object having been formed into a hank of loops, the cord holder comprising:

a collar;

a shank; and a suspension element, said collar, shank; and suspension element comprising a rigid material, said material being solid or tubular;

said collar having a form to confine, completely or nearly completely, the coiled elongate object at a central section of the hank between opposing ends of the loops of the hank;

said shank comprising three contiguous sections, a proximal section being in connection with said collar and orthogonal to a plane containing said collar;

a distal section being generally parallel to said proximal section; and a shoulder section interposed between and contiguous with said proximal section and said distal section, said shoulder section being sloped so that an orthogonal projection of said shoulder section onto the plane containing said collar intersects said collar, and wherein a projection of said shoulder section of said shank along the length of said shoulder section intercepts a plane containing said collar at an angle of less than 60°.

2. The cord holder of claim 1 wherein said collar completely encircles the hank.

3. The cord holder of claim 1 wherein said collar is partially open, the open collar further comprising at least one set of two opposing arms, each arm having a proximal end in connection with said proximal section of said shank, and each arm having a distal end.

4. The cord holder of claim 3 wherein the distal ends of the arms are connectable one to another by a re-openable means for the purpose of closing the open collar.

5. The cord holder of claim 4 wherein one or more of the distal ends of the arms has an appendage to provide said re-openable means.

6. The cord holder of claim 5 wherein said re-openable means comprises a hook and loop fastener, a hook portion of said hook and loop fastener being the appendage to the distal end of one arm and a loop portion of said hook and loop fastener being the appendage to the distal end of an opposing arm.

7. he cord holder of claim 1 wherein the suspension element comprises at least one aperture for mounting the cord holder to a surface.

8. The cord holder of claim 1 wherein the suspension element comprises the distal end of said shank formed as a hook.

9. The cord holder of claim 1 wherein the suspension element comprises the distal end of said shank formed as a tee.

10. The cord holder of claim 1 wherein said rigid material is metal.

11. The cord holder of claim 1 wherein said rigid material is wire.

12. The cord holder of claim 1 wherein said rigid material is plastic.

13. A method of preparing an elongate object for storage or transport, comprising:

forming the elongate object into a hank of loops;

inserting an end of said hank into a collar until said collar is located at a central section of said hank in an area of smaller cross-section than the loops at the ends of said hank, said collar being fixedly connected to a first end of a shank;

engaging the loops at one end of said hank with a second end of said shank; and adjusting said hank within said collar to cause the loops at said one end of said hank to rest firmly in contact with said shank, wherein said collar and said shank comprise a rigid material, said material being solid or tubular, and wherein the contact between said hank and said shank is in a region of said shank having a slope with respect to said collar of less than 60°.

14. The method of claim 13 wherein said collar completely encircles said hank.

15. A method of preparing an elongate object for storage or transport, comprising:

forming the elongate object into a hank of loops;

engaging the loops at one end of said hank with a first end of a shank;

gathering a central section of said hank and tucking said central section into a collar, said collar being fixedly connected to a second end of said shank;

adjusting said hank within said collar to cause the loops at said one end of said hank to rest firmly in contact with said shank, wherein said collar and said shank comprise a rigid material, said material being solid or tubular, and wherein the contact between said hank and said shank is in a region of said shank having a slope with respect to said collar of less than 60°.

16. The method of claim 15, further comprising:

closing an opening of said collar by a re-openable means.

17. A storage product for containment of a multiplicity of coiled elongate objects, said storage product comprising a multiplicity of the cord holder of claim 1.

18. The storage product of claim 17 wherein each cord holder from the multiplicity of cord holders is identical to each other cord holder from the multiplicity of cord holders, and the form of the collar and the shank of each cord holder is accommodative of stacking of the cord holders for the purpose of compacting the storage product when more than one cord holder from the multiplicity of cord holders is not in use.

19. The storage product of claim 17 wherein each cord holder from the multiplicity of cord holders differs in size from each other cord holder from the multiplicity of cord holders, and the storage product is compactable by beginning with the largest cord holder from the multiplicity of cord holders and progressively nesting within it the next smaller cord holder from the remainder of the multiplicity of cord holders.

* * * * *